US005104614A

United States Patent [19]

Ducrocq et al.

[11] Patent Number: 5,104,614

[45] Date of Patent: Apr. 14, 1992

[54] SUPERALLOY COMPOSITIONS WITH A NICKEL BASE

[75] Inventors: Christian A. B. Ducrocq, Taverny; Didier P. A. Lestrat, Soisy sur Seine; Bernard Paintendre, La Celle Saint Cloud; James H. Davidson, Varennes-Vauzelles; Michel Marty, Buc; André Walder, L'Hay les Roses, all of France

[73] Assignees: Societe Nationale d'Etude et de Construction de Moteurs d'Aviation "S.N.E.C.M.A."; Association pour la Recherche et le De'veloppement des Methodes et Processus Industriels - "A.R.M.I.N.E.S."; Tecphy, all of Paris; Office National d'Etudes et de Recherches Aerospatiales - "O.N.E.R.A.", Chatillon, all of France

[21] Appl. No.: 869,888

[22] Filed: Jun. 3, 1986

[30] Foreign Application Priority Data

Feb. 6, 1986 [FR] France ..... 86 01604

[51] Int. Cl.[5] ..... C22C 19/05

[52] U.S. Cl. ..... 420/448; 148/410; 148/428

[58] Field of Search ..... 420/448, 446, 449, 450; 148/404, 410, 428; 75/236, 238, 242, 244, 246

[56] References Cited

U.S. PATENT DOCUMENTS 3,494,709 2/1970 Piearcey ..... 148/404

*Primary Examiner*—R. Dean
*Assistant Examiner*—Margery S. Phipps
*Attorney, Agent, or Firm*—Oblon, Spivak, McClelland, Maier & Neustadt

[57] ABSTRACT

Superalloy with a nickel base matrix having good mechanical properties when hot in respect of tensile strength, creep resistance, low cycle fatigue and resistance to crack-propagation of which the composition in percentages by weight is as follows: Cr 11 to 13; Co 8 to 17; Mo 6 to 8; Nb less than or equal to 1.5; Ti 4 to 5; Al 4 to 5; Hf less than or equal to 1; C, B, Zr each less than or equal to 500 ppm; Ni remainder to 100. The alloy can be manufactured advantageously by powder metallurgy techniques and used in the manufacture of turbo machine disks.

2 Claims, 1 Drawing Sheet

SUPERALLOY COMPOSITIONS WITH A NICKEL BASE

BACKGROUND OF THE INVENTION

1. Field of the Invention

The present invention relates to superalloy compositions with a nickel base, for example intended for the manufacture of the disks of turbomachines, which may encounter temperatures up to 750° C. so as to meet with the requirements of thermodynamic cycles of turbomachines of very high efficiency and specific power.

2. Summary of the Prior Art

Turbine disks must use materials of moderate density having a series of mechanical properties when hot such that:

1) Tensile properties up to 750° C.: yield strength and elongation,

2) Creep strength up to 750° C.: high strength and absence of notch sensitivity, 3) Resistance to low cycle fatigue; and 4) As low as possible of propagation of cracks taking into account environmental effects and the time for which they are subject to prolonged loading for which it is known that it will become critical in the temperature range concerned; the importance of this property is confirmed by the introduction of tolerance requirements to damage, as for example in the November 1984 Edition of the Standard MIL-STD-17-83 of the USAF.

The materials developed on powder metallurgy principals are currently most suitable for meeting the technical requirements and in the current state of the art there are used:

1) either materials which have a high resistance to crack-propagation with a low sensitivity to the environment but of which the yield strength and the resistance to creep are inadequate at high temperature. U.S. Pat. No. 3,147,155 describes examples of superalloy compositions of this type (see alloy A in Table 1 hereinabove).

2) or materials which have an elevated yield strength but of which the sensitivity to notching under creep conditions, the resistance to crack-propagation and the sensitivity to the environment are not satisfactory; U.S. Pat. No. 3,061,426 and FR-A-2 244 827 likewise describe examples of superalloy compositions of this type (see alloys R and I in Table 1 which are discussed hereinafter).

Several examples of these alloy compositions are given in Table 1.

The improvement of certain of the mechanical properties (resistance to crack-propagation for example) can be provided by achieving particular microstructures (coarse grains, necklace structure). These improvements are made however to the disadvantage of other characteristics (the yield strength for example) and the object of the present invention is to produce an optimum series of properties referred to hereinbefore by new alloy compositions.

SUMMARY OF THE INVENTION

The present invention relate to a new family of nickel base superalloys having properties referred to hereinbefore, wherein the composition, in percentage by weight, have the following ranges:

| Cr | Co | Mo | Nb | Ti | Al | Hf | C | B | Zr |
|---|---|---|---|---|---|---|---|---|---|
| 11–13 | 8–17 | 6–8 | ≦1, 5 | 4–5 | 4–5 | ≦1 | ≦500 ppm | ≦500 ppm | ≦500 ppm |

the remainder being nickel.

Advantageously preferential ranges are maintained as follows:

CO : 14 to 17%

C : 0 to 200 ppm

B : 0 to 200 ppm

Two examples of alloys in accordance with the present invention are given as follows (N14 and N16):

| Percentage by weight | Cr | Co | Mo | Nb | Ti | Al | Hf | C ppm | B ppm | Zr ppm |
|---|---|---|---|---|---|---|---|---|---|---|
| N 14 | 11.9 | 15.8 | 6 | 1.4 | 4 | 4.3 | 0.32 | 150 | 150 | 500 |
| N 16 | 12 | 15.7 | 6.8 | 0 | 4.35 | 4.35 | 0.48 | 150 | 150 | 300 |

Advantageously, superalloys according to the invention are capable of being manufactured by powder metallurgy techniques and turbomachine disks provide a particularly appropriate application.

Nickel base superalloys have in general a structure which is essentially bi-phased with:

1) A $\gamma$ phase of Ni, Co hardened mainly by elements in solid solution (W, Cr, NO)

2) A hardening $\gamma'$ phase of type $A_c$ B in which A is mainly formed of NI, Co, Cr and B of Al, Ti, Nb, Ta, Hf, V, Ta.

The achievement of the desired mechanical properties is effected by intervening respectively in the two hardening modes which leads to the specification on the one hand of ranges of Al, Ti, Nb, Hf, V, Ta and on the other hand of W, Mo, and Cr.

The invention will be better understood and the advantages made fully clear with the aid of the description which follows of the justification of the principal choices and practical examples, with reference to the sole FIGURE which illustrates the influence of the ratio Mo, W on the life expectancy under rupture creep.

Specification of Nb, Al, Ti, Hf and V:

It is known that the introduction of Nb and of Ta substantially contributes to the increase in the yield strength strength with smooth creep, but Table 2 hereinafter shows that this beneficial effect is achieved to the detriment of the sensitivity to notching and to the resistance to crack-propagation under fatigue creep starting at 650° C. (see in particular the examples of alloys R and N 13 for the influence of Nb and the alloy examples NA10 and NA9 for the influence of Ta).

Tantalum has moreover, in relation to niobium, the disadvantage of increasing the density more markedly. For these reasons the alloys in accordance with the present invention do not include Ta and are limited to 1.5% of Nb.

Because of this limitation it is necessary, in order to achieve properties in the temperature range envisaged, to provide a volumetric fraction of $\gamma'$ of at least 50% achieved by the addition of Al and Ti which does not give rise to the disadvantages referred to. The invention provides for ranges of al and Ti such that their ratio should be about 1 because, as it is known that Ti is an element which is more favourable than Al for the hardening of the $\gamma'$ phase beyond 650° C., it increases very rapidly the temperature for return to solid solution of this phase, rendering the practical use of the alloy difficult. For this same reason the sum of the elements Al+Ti is limited to 10% by weight.

A complementary hardening can be produced by the addition of Hf, within the limit 1% for reasons of practical use (reduction of the solidus and increase of the solvus $\gamma'$).

Similarly, although it is known that an increase in hardening can be produced by the addition of vanadium, it has been established that the velocities of crack-propagation in fatigue creep at 650° C. are then excessive. For this reason the alloys according to the present invention do not include vanadium.

Specifications of Mo, W and Cr

Taking into account the limitations referred to hereinbefore, it is necessary for substantial hardening of the phase in solid solution $\gamma$. In order to effect this, the elements W and Mo are used which are known as effective hardeners of the matrix. Hardening by Mo is, in the present invention, preferred to that by W since:

1) The ratio of the concentration of Mo in the $\gamma$ phase at its concentration in the $\gamma'$ is two to three times higher than the corresponding ratio for W.

Figure 1:
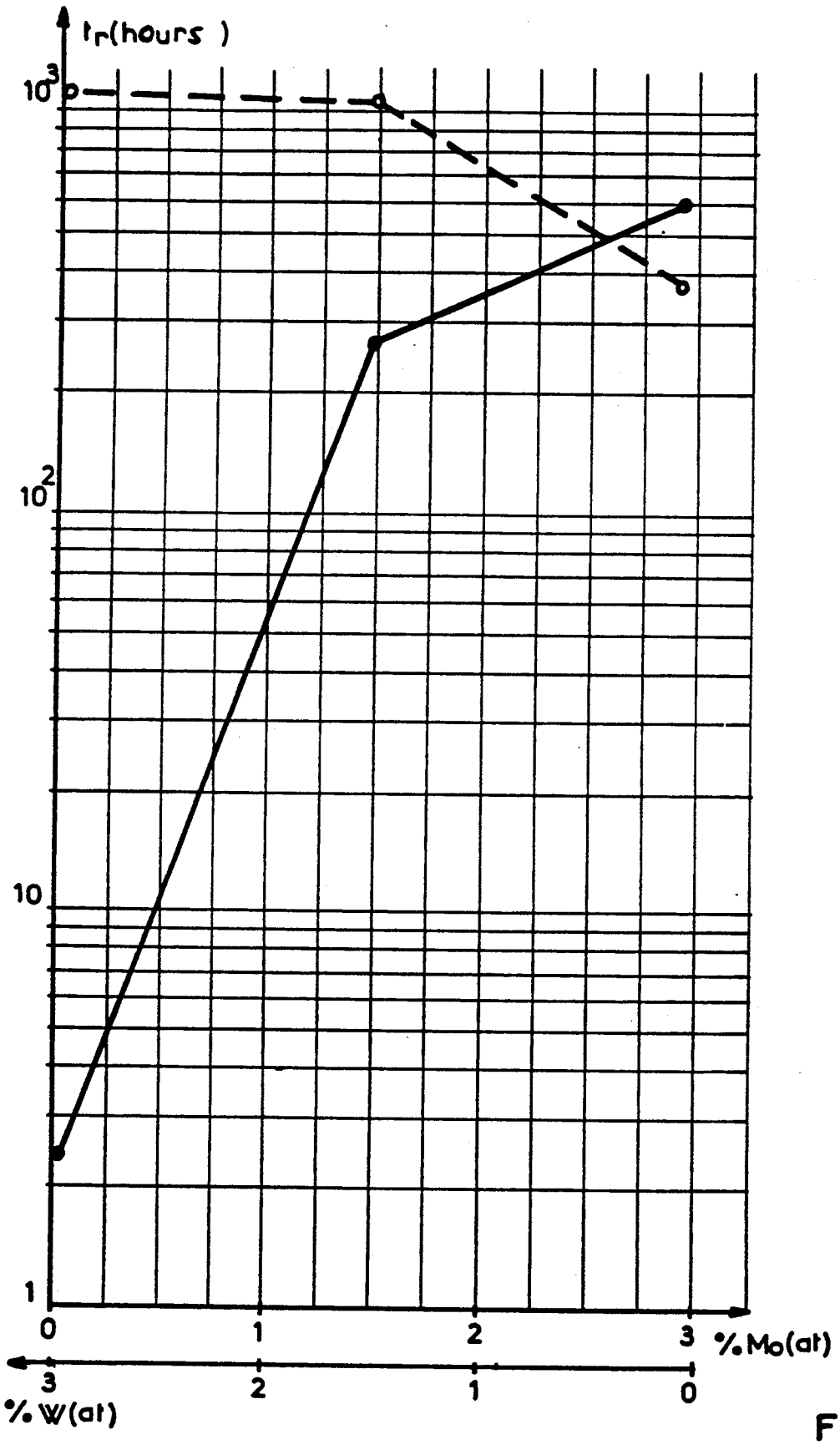
FIG. 1 illustrates that the substitution of Mo for W reduces the sensitivity to notching under creep conditions at 650° C. for a resistance to creep which is slightly inferior on a smooth test piece 2) In FIG. 1, $T_R$ as ordinate and on a logarithmic scale represents the duration of life in hours, in rupture creep at 650° C. under a load of 1000 MPa and as abscissa are related to the ranges of Mo and W in atomic percentages. A full line curve represents the results of creep effected on the test piece with a notch and a curve in broken lines the results of creep on a smooth test piece.

3) The density penalty is less with the element Mo than with W.

The present invention advocates a range of Mo lying between 6 and 8 percent by weight which, as Table 2 shows (see in particular the alloy examples according to the invention N14 and N16), resulting in high strength values in tension and creep. The alloy maintains nevertheless crack-propagation velocities under fatigue/-creep conditions which are particularly low.

It is known that the addition of chromium is necessary for resistance to oxidation and participates in the hardening of the alloy. However, for the ranges of Al, Ti and Mo reaching the levels recommended by the invention, the tests which have been carried out in relation to the invention have shown that a concentration of chromium in excess of 13% by weight causes abundant precipitation of intergranular carbides which cause a deterioration in ductility properties, sensitivity to notching and cracking, as is shown by the results for the alloy N17 illustrated in Table 2 shown hereafter.

For this reason the invention advocates a chromium range lying between 11 and 13 percent by weight.

Other Specifications

It is recognised that an amount of at least 8 percent by weight of cobalt is necessary for resistance to creep. This element reduces moreover the temperature of the solvus of the $\gamma'$ phase and, by reason of the high values of Al and of Ti of the present invention an amount of cobalt of at least 14 percent by weight is retained so as to facilitate the actual use of the material. This amount must be limited when making use of the material.

The amount must be limited to be in excess of 17% in order to maintain a volumetric fraction of $\gamma'$ sufficient for the use temperatures under consideration.

Boron and carbon are known elements capable of improving the resistance to creep, but taking into account the amounts of chromium and of molybdenum, and in order to avoid the formation of excessive carbides and borides, the invention limits their concentration by weight to 500 ppm.

Zirconium can be useful in order to fix possible weakening traces of sulfur, but limits its amount to 500 ppm by weight in order to avoid the formation of phases with a low melting point.

Other elements such as Mg, Ca, Si, Y etc. often used for the development of superalloys, can remain present at the trace levels without harming the properties of the alloys in accordance with the invention.

By way of example, there has been studied more particularly two alloys (N14 and N16) of the family in accordance with the invention. Their composition is given in the Table 1 hereinafter where the ranges of each element are expressed as a concentration by weight.

TABLE 1

| | Cr % | Co % | Mo % | W % | Al % | Ti % | Nb % | Ta % | Hf % | V % | C In ppm | B In ppm | Zr in ppm | Ni |
|---|---|---|---|---|---|---|---|---|---|---|---|---|---|---|
| A | 14.6 | 16.6 | 5.0 | — | 4.0 | 3.5 | — | — | — | — | 280 | 280 | 600 | REMAINDER |
| R | 12.7 | 8.0 | 3.6 | 3.2 | 3.5 | 2.5 | 3.4 | — | — | — | 240 | 75 | 500 | " |
| I | 12.1 | 18.7 | 3.2 | — | 5.3 | 4.7 | — | — | — | 0.8 | 900 | 200 | 600 | " |
| M | 12.5 | 17.3 | 3.2 | — | 5.1 | 4.7 | 1.7 | — | 1 | — | 250 | | | " |
| N13 | 13.4 | 8.1 | 5.3 | — | 3.8 | 1.8 | 5.8 | — | 0.19 | — | 120 | 145 | 480 | " |
| N17 | 15.7 | 15.9 | 5.5 | — | 4.4 | 4.4 | 0.85 | — | 0.51 | — | 100 | 145 | 550 | " |
| NA4B | 9.9 | 10.4 | 5.0 | — | 4.1 | 2.1 | 6.0 | — | — | — | 180 | 90 | 500 | " |
| NA1O | 9.6 | 10.0 | 4.8 | — | 3.8 | 1.9 | 2.9 | 6.1 | — | — | 140 | 90 | 500 | " |
| NA9 | 9.5 | 10.0 | 4.6 | — | 3.9 | 2.0 | — | 11.5 | — | — | 140 | 100 | 500 | " |
| NC1 | 9.4 | 10.0 | — | 9.1 | 3.9 | 1.9 | 6.1 | — | — | — | 200 | 100 | 550 | " |
| N14 | 11.9 | 15.8 | 6.0 | — | 4.3 | 4.0 | 1.4 | — | 0.32 | — | 90 | 130 | 510 | " |
| N16 | 12.0 | 15.8 | 6.8 | — | 4.3 | 4.3 | — | — | 0.97 | — | 100 | 130 | 520 | " |

For each alloying variation, mechanical tests have been carried out on test pieces of which the production had lead to a coarse grained structure (in excess or equal to 50 μm) or to a "necklace" and on test pieces of which the production had lead to a structure with fine grain (less than or equal to 10 μm). Each test piece manufactured is subject to a sequence of heat treatments before testing so as to optimize the properties of the alloys.

The characterisation tests comprise:

1) Tensile tests for which there are noted the yield strengths R 0.2 in MPa at 650° C. and at 750° C. and elongations A% at 750° C.;

2) Creep tests at 750° C. in air under a loading at 600 MPa for which are noted the time to rupture on a smooth test piece tRL in hours and the ratio $\tau$ between the time to rupture on notches test pieces/time to rupture on the smooth test piece;

3) Cyclic crack-propagation tests at 650° C. in air for which are noted the values of the rate of crack-propagation da/dN in mm per cycle; with amplitude of the factor of intensity of loading $$\Delta K = 30\ MPa\sqrt{m} \text{ and } \Delta K = 60\ MPa\sqrt{m}$$

Dwell time under tensile load maximum $t_m = 300$ s.

The results obtained are set out in Table 2 hereinafter which also brings together the comparative results obtained with known alloys in the state of the art of which the corresponding compositions are likewise given in the Table 1 hereinbefore.

These results are obtained by applying to the test pieces a rate of cooling of 100° C. per minute after returning to solution the $\gamma'$ phase. This rate corresponds to a cooling rate at the core of the pieces liable to be realised in practice in an alloy in accordance with the invention.

These results shown that the superalloys in accordance with the invention enable the provision of an optimum composition required with mechanical properties when hot giving good results in resistance to crack-propagation with similarly good results in tension and in creep up to 750° C.

The use of superalloys in accordance with the invention can take into account any process avoiding the production of major segregations of the kind which appear when such alloys are made according to conventional foundary practice. Thus the production of superalloys according to the invention can in particular be effected by known techniques of powder metallurgy and parts made in the case of alloys such as the disks of the rotor of a turbo machine can for example be manufactured by known procedures of hot isostatic pressure.

TABLE 2

| | STRUCTURE WITH COARSE GRAINS (≧50 μm or necklace) | | | | | | | STRUCTURE WITH FINE GRAINS (≦10 μm) | | | | | | |
|---|---|---|---|---|---|---|---|---|---|---|---|---|---|---|
| | TENSILE | | | CREEP 750° C. - 600 MPa | | CRACK-PROPAGATION 650° C. da/dN with tm = 300 s | | TENSILE | | | CREEP 750° C. - 600 MPa | | CRACK-PROPAGATION 650° C., tm = 300 s da/dN | |
| SUPER-ALLOY | R 0,2 650° C. | R 0,2 750° C. | A % 750° C. | $t_{RL}$ | $\tau$ | Δk = 30 | Δk = 60 | R 0,2 650° C. | R 0,2 750° C. | A % 750° C. | $t_{RL}$ | $\tau$ | Δk = 30 | Δk = 60 |
| A | 910 | 931 | 21 | 44 | >6 | $1.5.10^{-3}$ | $1.3.10^{-2}$ | 1022 | 960 | 13 | 25 | 0.3 | $8.10^{-3}$ | $5.10^{-2}$ |
| R | 1060 | 1090 | 9 | 64 | 0.6 | $2.10^{-2}$ | $>5.10^{-1}$ | 1125 | 1023 | 2 | 17 | 0.04 | $2.10^{-2}$ | $>3.10^{-1}$ |
| I | | | | | | | | 1038 | 960 | 10 | 12 | 0.8 | $2.10^{-2}$ | $10^{-1}$ |
| M | | | | | | | | 1010 | 975 | | | — | $3.10^{-3}$ | $4.10^{-2}$ |
| N13 | 1086 | 1114 | 12 | 80 | 0.4 | $3.10^{-3}$ | $3.10^{-1}$ | 1198 | 1060 | 4 | 7.2 | 0.2 | $2.5.10^{-1}$ | >5.10° |
| N14 | 985 | 990 | 16 | 45 | 2.5 | $10^{-3}$ | $8.10^{-3}$ | 1050 | 1025 | 15 | 93 | 2.5 | $4.10^{-3}$ | $3.10^{-2}$ |
| N16 | 997 | 963 | 11 | 70 | 2.0 | $10^{-3}$ | $5.5.10^{-3}$ | 1037 | 985 | 16 | 27 | >1 | $10.^{-3}$ | $7.5.10^{-3}$ |
| N17 | 1115 | 1067 | 6 | 13 | 1.0 | $10^{-3}$ | $2.10^{-1}$ | | | | | | | |
| NA 4 B | 1102 | 1087 | 10.5 | 97 | 0.2 | — | — | | | | | | | |
| NA 10 | 1093 | 1110 | 10.5 | 130 | 0.3 | — | — | | | | | | | |
| NA 9 | 1068 | 1126 | 9.6 | 133 | 0.07 | — | — | | | | | | | |
| NC 1 | 1150 | 1123 | 9.2 | 231 | <0.01 | — | — | | | | | | | |

We claim:

1. A superalloy having a nickel base matrix and having good tensile strength, creep resistance, low cycle fatigue and resistance to crack-propagation when heated, which consists essentially of in weight percent: Cr, 11.9; Co, 15.8; Mo, 6; Nb, 1.4; Ti, 4; Al, 4.3; Hf, 0.32; C, 150 ppm; B, 150 ppm; Zr, 500 ppm; with the remainder of Ni to 100.

2. A superalloy having a nickel base matrix and having good tensile strength, creep resistance, low cycle fatigue and resistance to crack-propagation when heated, which consists essentially of in weight percent: Cr, 12; Co, 15.7; Mo, 6.8; Nb, 0; Ti, 4.35; Al, 4.35; Hf, 0.48; C, 150 ppm; B, 150 ppm; Zr, 300 ppm; and the remainder of Ni to 100.

* * * * *

UNITED STATES PATENT AND TRADEMARK OFFICE

CERTIFICATE OF CORRECTION

PATENT NO. : 5,104,614

DATED : April 14, 1992

INVENTOR(S) : Christian A.B. DUCROCQ, et al

It is certified that error appears in the above-identified patent and that said Letters Patent is hereby corrected as shown below:

Column 1, Line 52, "hereinabove)", should read --hereinafter)--.

Column 2, Line 6, "relate", should read --relates--.

Column 2, Line 38, "Cr, NO)", should read --Cr, No)--.

Column 2, Line 39, "$A_cB$", should read --$A_3B$--.

Column 2, Line 40, "NI,", should read --Ni,--.

Column 3, Line 6, "of al", should read --of Al--.

Column 3, Line 37, "FIG. 1", should read --2) FIG. 1--.

Column 3, Line 41, "2) In FIG. 1, $T_R$", should read --In FIG. 1, $t_R$--.

Column 5, Line 10, "at 600", should read --of 600--.

Signed and Sealed this

Twenty-ninth Day of March, 1994

*Attest:*

*Attesting Officer*

BRUCE LEHMAN

*Commissioner of Patents and Trademarks*